US008995869B2

(12) United States Patent
Park et al.

(10) Patent No.: US 8,995,869 B2
(45) Date of Patent: Mar. 31, 2015

(54) IMAGE FORMING APPARATUS

(71) Applicant: SAMSUNG Electronics Co., Ltd., Suwon-si, Gyeonggi-do (KR)

(72) Inventors: Heung-sup Park, Suwon-si (KR); Sung-jun Park, Hwaseong-si (KR); Hyouk-soo Han, Seoul (KR); Yung-mi Kim, Seoul (KR); Yoon-seok Kim, Suwon-si (KR); Young-bong Kim, Yongin-si (KR); Sun-hyung Lee, Suwon-si (KR); Taek-yong Jung, Suwon-si (KR); Gwang-hyun Jo, Suwon-si (KR)

(73) Assignee: SAMSUNG Electronics Co., Ltd., Suwon (KR)

( * ) Notice: Subject to any disclaimer, the term of this patent is extended or adjusted under 35 U.S.C. 154(b) by 115 days.

(21) Appl. No.: 13/707,165

(22) Filed: Dec. 6, 2012

(65) Prior Publication Data

US 2013/0183061 A1 Jul. 18, 2013

(30) Foreign Application Priority Data

Jan. 16, 2012 (KR) ..... 10-2012-0004972

(51) Int. Cl.

| | |
|---|---|
| ***G03G 21/00*** | (2006.01) |
| ***G03G 15/02*** | (2006.01) |
| ***G03G 15/00*** | (2006.01) |

(52) U.S. Cl.

CPC ..... *G03G 15/0258* (2013.01); *G03G 15/657* (2013.01)

USPC ..... 399/98

(58) Field of Classification Search

USPC ..... 399/98

See application file for complete search history.

(56) References Cited

U.S. PATENT DOCUMENTS

| | | | | |
|---|---|---|---|---|
| 6,058,287 | A * | 5/2000 | Haneda et al. | 399/397 |
| 2002/0034409 | A1 * | 3/2002 | Furuya et al. | 399/333 |
| 2008/0217556 | A1 * | 9/2008 | Kagawa et al. | 250/423 R |

FOREIGN PATENT DOCUMENTS

| | | |
|---|---|---|
| JP | 08-318667 | 12/1996 |
| JP | 2003-117512 | 4/2003 |
| JP | 2006-205700 | 8/2006 |
| JP | 2007-047496 | 2/2007 |

* cited by examiner

*Primary Examiner* — David Bolduc
*Assistant Examiner* — Barnabas Fekete
(74) *Attorney, Agent, or Firm* — Staas & Halsey LLP

(57) ABSTRACT

An image forming apparatus includes a developing module which develops a toner image on a printing medium, a fixing module which fixes the toner image onto the printing medium, and a toner neutralization module arranged on a travel path of the printing medium between the developing module and the fixing module to electrically neutralize the toner image on the printing medium.

21 Claims, 9 Drawing Sheets

<FP/UFP PRODUCING MECHANISM>

IMAGE FORMING APPARATUS

CROSS-REFERENCE TO RELATED APPLICATIONS

This application claims priority from Korean Patent Application No. 10-2012-0004972, filed on Jan. 16, 2012, in the Korean Intellectual Property Office, the disclosure of which is incorporated herein by reference in its entirety.

BACKGROUND

1. Field

Devices and methods consistent with the present general inventive concept provided herein relate to an image forming apparatus, and more specifically, to an image forming apparatus which reduces an amount of discharged micro-particles.

2. Description of the Related Art

An image forming apparatus adopting electrophotographic printing method such as printer, copier, and/or facsimile generally includes a developing module and a fixing module. The developing module develops a toner image on a printing medium, and the fixing module fixes the toner image into the printing medium.

When fixing the image, the printing medium is subject to heat and pressure from the fixing module, and the toner of the toner image on the printing medium may produce undesirable gases.

Particularly, excessive amounts of nano-scaled fine particles (FP) and ultrafine particles (UFP), which are extremely small, may be discharged externally from the image forming apparatus, and may be inadvertently introduced to humans.

SUMMARY

Exemplary embodiments of the present inventive concept overcome the above disadvantages and other disadvantages not described above. Also, the present general inventive concept is not required to overcome the disadvantages described above, and an exemplary embodiment of the present general inventive concept may not overcome any of the problems described above.

Additional features and utilities of the present general inventive concept will be set forth in part in the description which follows and, in part, will be obvious from the description, and/or may be learned by practice of the general inventive concept.

According to one exemplary embodiment, a technical objective is to provide an image forming apparatus which may reduce an amount of discharged fine particles (FP) and ultrafine particles (UFP).

In one exemplary embodiment, an image forming apparatus adopting an electrophotographic printing method is provided, which may include a developing module which develops a toner image on a printing medium, a fixing module which fixes the toner image onto the printing medium, and a toner neutralization module arranged on a travel path of the printing medium between the developing module and the fixing module to electrically neutralize the toner image on the printing medium.

The toner neutralization module may include an electric charge elimination member which is arranged in contact with the printing medium, is connected to the ground, and which has conductivity.

The toner neutralization module may additionally include a power source to apply voltage to the electric charge elimination member.

The power source may include a direct current (DC) power source, and is connected to the electric charge elimination member.

The electric charge elimination member may have a plate-like shape, with one surface being in contact with the printing medium.

The electric charge elimination member may include at least one pointed protrusion formed on one surface to be in contact with the printing medium.

The toner neutralization module may include an ion spray member which provides ions onto the printing medium to electrically neutralize the toner image.

The image forming apparatus may additionally include an electromagnetic filter module which filters harmful particles generated by the fixing module using electromagnetic force.

The harmful particles may include fine particles (FP) and ultrafine particles (UFP).

The image forming apparatus may include a paper ejection outlet through which the printing medium is discharged from the image forming apparatus, and the electromagnetic filter module may be arranged on a travel path of the printing medium between the fixing module and the paper ejection outlet.

The electromagnetic filter module may be installed adjacent to the paper ejection outlet.

The image forming apparatus may include at least one air outlet to discharge air in the image forming apparatus to outside, and the electromagnetic filter may be installed adjacent to the air outlet.

The electromagnetic filter module may include a magnetic field forming member to form a magnetic field therearound.

The magnetic field forming member may include a permanent magnet and/or an electromagnet.

The electromagnetic filter module may include an electric field forming member to form an electric field therearound.

The electric field forming member may include a conductor through which electric current flows.

The electromagnetic filter module may include a magnetic field forming member to form a magnetic field therearound, and an electric field forming member to form an electric field therearound.

In one exemplary embodiment, an image forming apparatus adopting an electrophotographic printing method may include a developing module which develops a toner image on a printing medium, a fixing module which fixes the toner image onto the printing medium, and an electromagnetic filter module which filters harmful particles generated by the fixing module using electromagnetic force.

In one exemplary embodiment, an image forming apparatus adopting electrophotographic printing method may include a developing module which develops a toner image on a printing medium, a fixing module which fixes the toner image onto the printing medium, a toner neutralization module arranged on a travel path of the printing medium between the developing module and the fixing module to electrically neutralize the toner image on the printing medium, and an electromagnetic filter module which filters harmful particles discharged from the image forming apparatus using electromagnetic force.

In an exemplary embodiment, an image forming apparatus has at least a developing module and a fixing module that perform an electrophotographic printing method. The image forming apparatus includes a printing system and an harmful material reducing module. The printing system is in electrical communication with a power source and includes at least a developing module that develops a toner image on a printing medium that travels on a travel path to a fixing module that fixes the toner image onto the printing medium. Further, the harmful material reducing module includes at least one of an electric charge eliminating member and an electromagnetic filter module. The electric charge eliminating member is in electrical communication with the power source and is arranged on the travel path of the printing medium between the developing module and the fixing module to neutralize electrified charges of a toner image on the printing medium. The electromagnetic filter module is in electrical communication with the power source and is arranged proximate to a printing medium ejection outlet to attract charged fine particles and ultrafine particles to minimize output of the fine particles and ultrafine particles.

The electric charge eliminating member may be one of an electrically conductive material that includes one of a rectangular plate form, a cylindrical shape, and a plate-shaped body with pointed protrusions, and/or may be an ion-spraying member.

The electromagnetic filter module may include one of a rectangular plate of a permanent magnet, a cylindrical-shaped magnetic field forming member, an electromagnet that includes a core member and coils, and an electromagnetic field forming member in electrical communication with the power source.

In an exemplary embodiment, an image forming apparatus performs an electrophotographic printing method and minimizes output of charged fine particles and ultrafine particles. The image forming apparatus includes a printing system which is in electrical communication with a power source and an harmful material reducing module. The harmful material reducing module includes at least one of an electric charge eliminating member and an electromagnetic filter module. The electric charge eliminating member is in electrical communication with the power source and is arranged on a travel path of a printing medium in the printing system to neutralize electrified charges of a toner image on the printing medium. In addition, the electromagnetic filter module is in electrical communication with the power source and is arranged proximate to a printing medium ejection outlet to attract charged fine particles and ultrafine particles, minimizing output of the fine particles and ultrafine particles.

The printing system may include at least a developing module that develops the toner image on the printing medium that travels on the travel path and a fixing module that fixes the toner image onto the printing medium.

In an exemplary embodiment, an image forming apparatus includes a filter unit formed with a wall of the image forming apparatus to filter undesired particles traveling along an outlet path. The filter unit may include at least one air ventilation outlet/vent formed in the wall and aligned with the outlet path to receive the undesirable particles therethrough and an electromagnetic filter module disposed adjacent the at least one vent to generate a magnetic field that attracts the undesirable particles traveling toward the vent to the electromagnetic filter module.

The electromagnetic filter module may include a surface facing the outlet path such that the undesirable particles adhere to the surface due to an electromagnetic attractive force of the electromagnetic filter module. Further, a ledge may extend parallel with the outlet path and may have a surface facing the outlet path. The electromagnetic filter module may be coupled to the ledge and may face the outlet path through the at least one vent.

In addition, the at least one vent may include a plurality of vents, each vent aligned with a respective outlet path to receive undesired particles passing therethrough.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which.

DETAILED DESCRIPTION OF THE EXEMPLARY EMBODIMENTS

Figure 1:
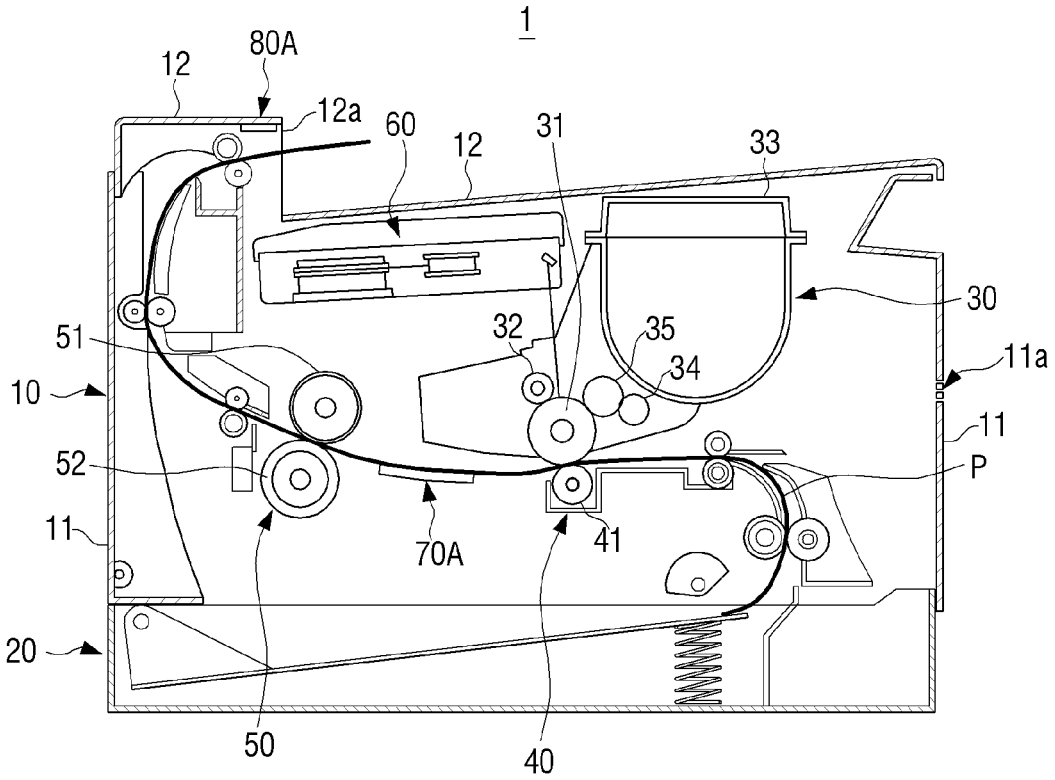
FIG. 1 is a schematic cross-section view of an image forming apparatus according to an exemplary embodiment.

Reference will now be made in detail to the exemplary embodiments of the present general inventive concept, examples of which are illustrated in the accompanying drawings, wherein like reference numerals refer to the like elements throughout. The exemplary embodiments are described below to explain the present general inventive concept while referring to the figures.

FIG. 1 is a schematic cross-section view of an image forming apparatus according to an exemplary embodiment. The image forming apparatus may also be other types of the image-forming apparatuses that adopt the electrophotographic printing method, such as a copy machine or a facsimile.

Referring to FIG. 1, an image forming apparatus 1 may include a main body 10 and a printing medium supply module 20 which provides the recording medium by a single basis to the main body 10 established below the main body 10.

The main body 10 may include a side casing 11 having a plurality of air ventilation outlets/vents 11*a* and an upper casing 12 having a paper outlet 12*a*. The main body 10 may further include a developing module 30, a transfer module 40, a fixing module 50, and a light scanning module 60 in the inner area defined by the casings 11 and 12.

The developing module 30 may include an image holding member 31, a charge roller 32, a toner cartridge 33, a toner supply roller 34, and a developing roller 35. The charge roller 32 may charge the image holding member 31 with a specific potential, the toner supply roller 34 may provide the toner of the toner cartridge 33 to the developing roller 35, and the developing roller 35 may develop the toner image corresponding to the electrostatic latent image on the image holder member 31.

The transfer module 40 may include a transfer roller 41 which is opposed to the image holding member 31 with a transfer nip formed therebetween. When the printing medium passes through the transfer nip between the image holding member 31 and the transfer roller 41, the toner image on the image holding member 31 is formed on (transferred onto) the printing medium.

The fixing module 50 may include a heating member 51 and a pressuring member 52 formed opposite to each other. Referring to FIG. 1, the heating member 51 and the pressuring member 52 may be a heating roller and a pressuring roller. The printing medium may be heated and pressed upon passing through the fixing nip between the heating member 51 and the pressuring member 52 so that the toner image is fixed onto the printing medium by the heat and the pressure.

The scanning module 60 may form an electrostatic latent image on the surface of the image holding member 31. For instance, the scanning module 60 may be the laser scanning module (LSU) which emits a laser beam onto the image holding member 31 to form electrostatic latent image.

The printing process of the image forming apparatus 1 will be explained below along the travel path (P) of the printing medium. The printing medium in the supply module 20 of the printing medium may be picked up on a single sheet basis and enter the main body 10. When the printing medium passes through the transfer nip between the image holding member 31 and the transfer roller 41, the toner image is formed on the surface of the printing medium. When the printing medium passes through the fixing nip between the heating member 51 and the pressuring member 52 of the fixing module 50, the tone image is fixed by the heat and pressure. After the image is fixed, the printing medium is discharged through the paper ejection outlet 12*a* of the upper casing 12.

Harmful materials may be produced by the image forming apparatus 1 while printing. The harmful materials may be fine particles (FP) and ultrafine particles (UFP).

It has been understood that the FP and UFP are produced from materials involved with the toner and the image fixation by the heat applied to fix the image. Accordingly, attempts to reduce the amount of the FP and UFP have focused mostly on developing the toner which may be fixed at a lower temperature. However, this requires that such toner fixable at a lower temperature be developed first, and that the control conditions of the image forming apparatus be re-set based on the newly-developed toner.

By conducting several tests on the FP and UFP produced from the image forming apparatus 1, a mechanism which is different from the already-known mechanism has been shown to produce the FP and UFP.

Figure 2:
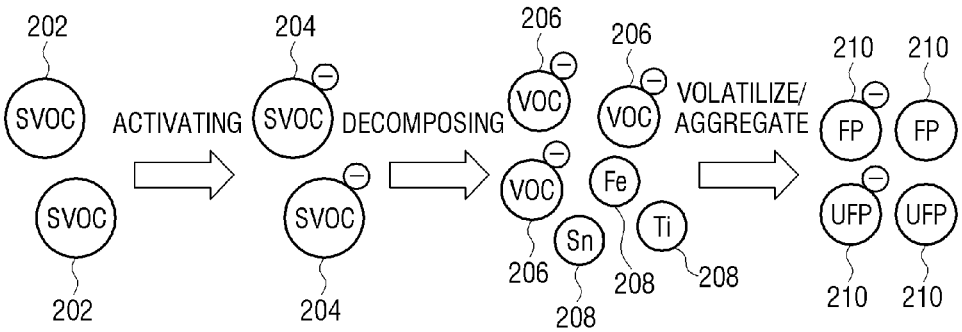
FIG. 2 is a diagram illustrating a mechanism of producing fine particles and ultrafine particles according to an exemplary embodiment.

This will be explained below with reference to FIG. 2. FIG. 2 is a diagram illustrating a mechanism of producing fine particles and ultrafine particles according to an exemplary embodiment.

The toner is a mixture of various components including the semi-volatile organic compounds (SVOC 202). The SVOC 202 of the toner may include wax, pigment, etc.

When the toner image develops on the image holding member 31, some electric charges (e.g., electrons) may be charged on the surface of the image holding member 31. Referring to FIG. 2, the SVOC 204 included in the toner is electrified by the electric charges, and activated. The SVOC 204 electrified/activated by the electrons according to one exemplary embodiment will be described below for convenience of explanation.

Referring to FIG. 2, the 'activated' SVOC 204 contained in the toner image is heated and pressured by the fixing module 50 in the toner image fixing process, and decomposed into the volatile organic compounds (VOC- 206). Metal materials 208 such as Fe, Sn, and Ti may also be decomposed from the toner.

If the SVOC 202 is not activated by electrons, the SVOC 202 is stable and thus, is hardly decomposable.

As the name suggests, the VOC- has a lower vaporization point than the SVOC 202. In other words, the VOC- evaporates at a lower temperature than the SVOC 202. As used herein, the 'vaporization' includes volatilization and evaporation. Thus, if the air temperature in the fixing module 50 is about 180° C. to 190° C., the VOC- volatilizes to a gaseous state while the SVOC 202 does not.

Referring to FIG. 2, the VOC- in the gaseous state either agglomerate to each other and/or to the seed material, such as Fe, Sn, and/or Ti, thereby producing the FP and UFP. A considerable amount of FP and/or UFP is electrified with the electrons which originated from the SVOC 202 before decomposition.

Considering the producing mechanism of the FP and UFP explained above, attempts to reduce the amount of the FP and UFP may be achieved accordingly to different reducing methods. A first reducing method may include preventing decomposition of the SVOC 202 in the image fixing process by eliminating the electrified charges such as electrons from the toner image before the tone image is fixed. A second reducing method may include directly eliminating the produced FP and UFP.

Referring back to FIG. 1, the image forming apparatus 1 may include a toner neutralization module 70A and an electromagnetic filter module 80A. The toner neutralization module 70A may apply the above-mentioned first reducing method to eliminate the electrified charges of the toner image. The electromagnetic filter module 80A may apply the above-mentioned second reducing method to eliminate the produced FP and UFP. However, it is appreciated that modules 70A and 80A are not limited to these reducing methods.

The toner neutralization module 70A will be explained below.

Figure 3:
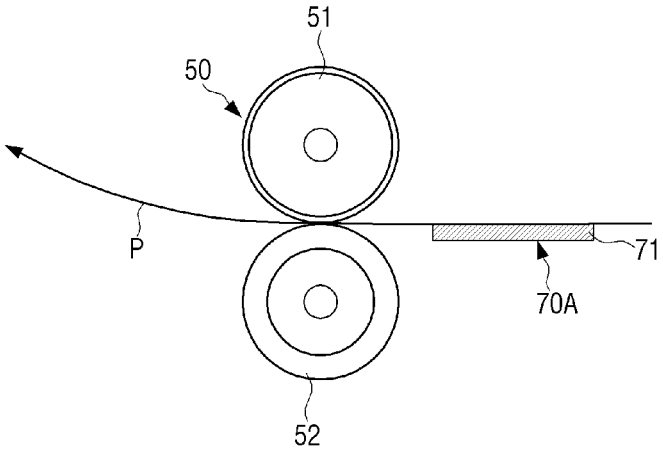
FIG. 3 is an enlarged view of a surrounding area of the fixing module of FIG. 1 according to an exemplary embodiment.
Figure 4:
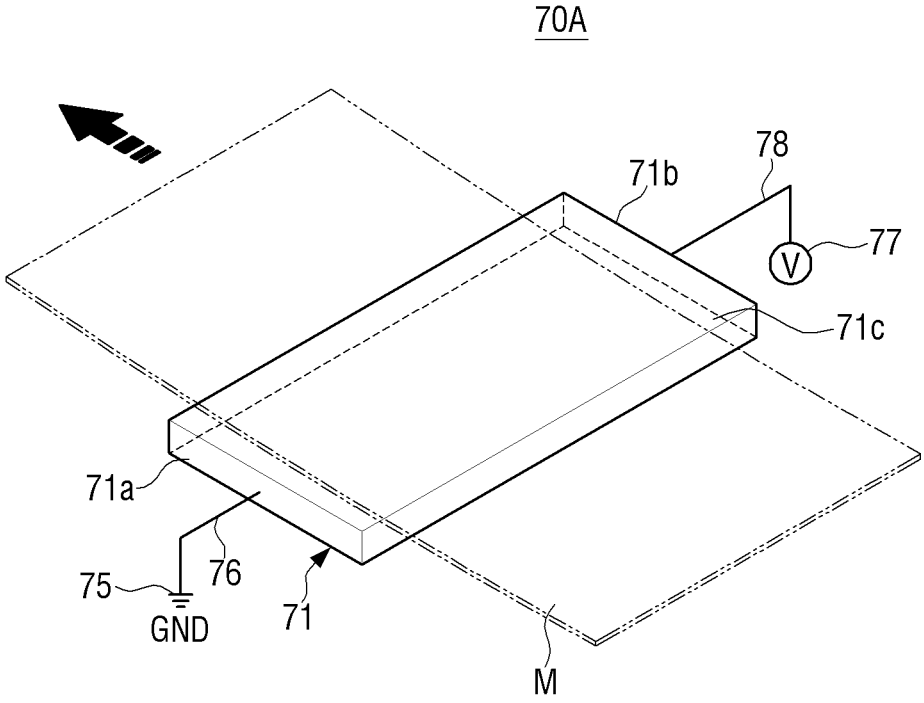
FIG. 4 is a schematic perspective view of a toner neutralization unit included in the image forming apparatus of FIG. 1 according to an exemplary embodiment.
Figure 5:
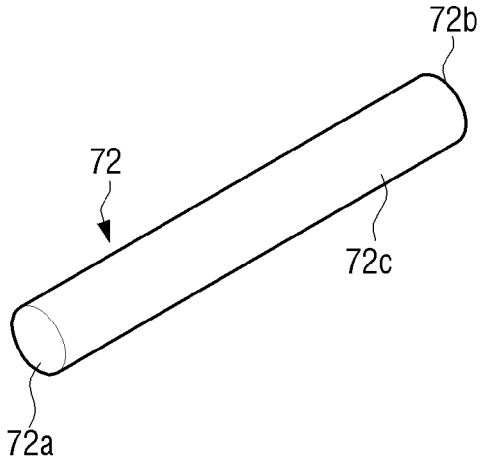
FIG. 5 is a perspective view of an electric charge eliminating member included in the toner neutralization module of FIG. 4 according to an exemplary embodiment.
Figure 6:
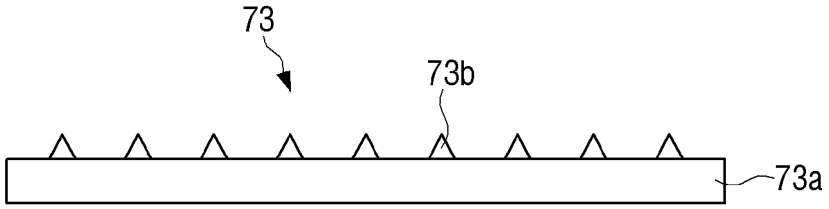
FIG. 6 is a perspective view of the electric charge eliminating member included in the toner neutralization module in FIG. 4 according to another exemplary embodiment.
Figure 7:
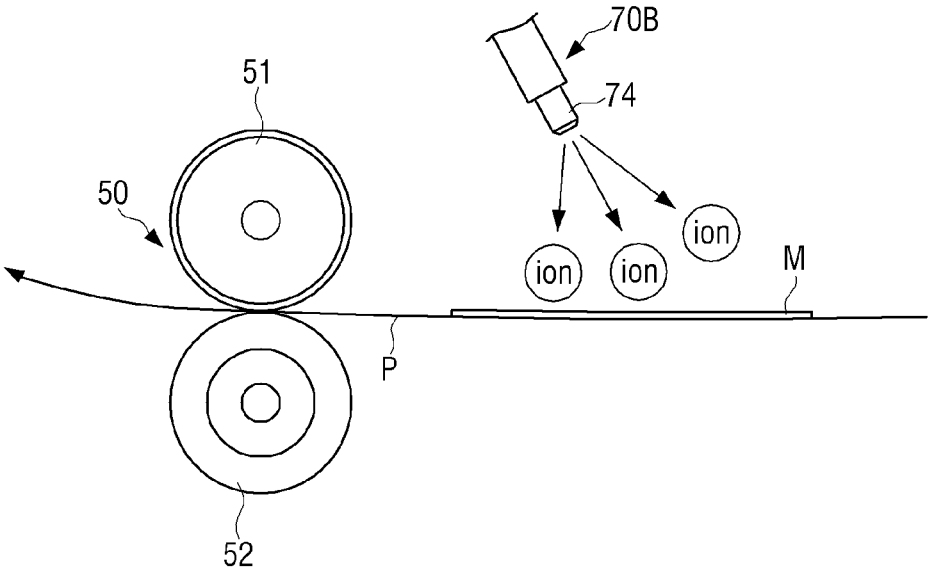
FIG. 7 is a schematic diagram illustrating a toner neutralization module according to an exemplary embodiment.

FIG. 3 is an enlarged view of a surrounding area of the fixing module of FIG. 1 according to an exemplary embodiment. FIG. 4 is a schematic perspective view of a toner neutralization module 70A included in the image forming apparatus 1 of FIG. 1 according to an exemplary embodiment. Further, FIG. 5 is a perspective view of an electric charge eliminating member 71 included in the toner neutralization module 70A of FIG. 4 according to an exemplary embodiment. FIG. 6 is a perspective view of the electric charge eliminating member 71 included in the toner neutralization module 70A in FIG. 4 according to another exemplary embodiment, and FIG. 7 is a schematic diagram provided to illustrate a toner neutralization module 70A according to an exemplary embodiment.

Referring to FIGS. 3 and 4, the toner neutralization module 70A may be arranged adjacent to the fixing module 50. In at least one exemplary embodiment, the toner neutralization module 70A may be arranged on the travel path (P) of the printing medium between the developing module 30 and the fixing module 50 as illustrated in FIG. 1.

As shown in FIG. 4, the toner neutralization module 70A may include an electric charge eliminating member 71 and a power source 77.

The electric charge eliminating member 71 may include conductive materials, including, but not limited to metal materials and may take a rectangular plate form, for example. However, the electric charge eliminating member 71 may include different shapes, as discussed further below.

The electric charge eliminating member 71 may be arranged on the travel path P of the printing medium between the developing module 30 and fixing module 50. An upper face 71*c* of the electric charge eliminating member 71 may contact a lower face of the printing medium M. For example, one end 71*a* of the electric charge eliminating member 71 may be connected to a ground source 75 through an electric wire 76. The other end 71*b* of the electric charge eliminating member 71 may be connected to the power source 77 through an electric wire 78.

The power source 77 includes, but is not limited to, direct current (DC). A positive pole of the power source 77 may be connected to the electric charge eliminating member 71 via the electric wire 78. In at least one exemplary embodiment, the power source may be excluded. However, if the power source 77 providing the voltage of the electric charge eliminating member 71 is included, the performance of the electric charge eliminating member 71 to eliminate the charges may be further enhanced. Meanwhile, the negative pole of the power source 77 is connected to the electric charge eliminating member 71. Accordingly, the electric charge eliminating member 71 may eliminate the positive charges on the printing medium.

The printing medium M with the toner image formed thereon contacts the upper face 71*c* of the electric charge eliminating member 71 in the toner neutralization module 70A before moving into the fixing module 50. The charges (i.e., electrons in this exemplary embodiment) electrified to the toner image exit to the ground source 75 through the electric charge eliminating member 71. Thus, the electrified/activated SVOC 204 included in the toner image may also be eliminated. For example, when the printing medium M contacts the electric charge eliminating member 71, the toner image on the printing medium M is neutralized electrically and the electrified/activated SVOC 204 in the toner image is also neutralized, i.e., the electrical charge of the SVOC 204 is removed. Accordingly, the amount of the electrified/activated SVOC 204 is reduced greatly.

Given the fact that the electrified/activated SVOC 204 greatly contributes to the production of the FP and UFP, the amount of the FP and UFP may be greatly reduced according to an exemplary embodiment described above, because the toner neutralization module 70A may greatly reduce the amount of the electrically activated SVOC 204 by neutralizing the toner image electrically before image fixing.

The form of the electric charge eliminating member 71 included in the toner neutralization module 70A may not be limited to the plate, and accordingly, other various forms may apply.

In one exemplary embodiment, referring to FIG. 5, the electric charge eliminating member 72 may be provided in a cylindrical shape. Both sides 72*a* and 72*b* of the electric charge eliminating member 72 may be connected to the ground source 75 and the power source 77. An outer circumference 72*c* of the electric charge eliminating member 72 may contact the printing medium.

In another exemplary embodiment, referring to FIG. 6, the electric charge eliminating member 73 may include a plate-shaped body 73*a* and pointed protrusions 73*b*. The protrusions 73*b* may contact the printing medium. Accordingly, the electric charge elimination efficiency of the electric charge eliminating member 73 may be further enhanced.

FIG. 7 is a schematic diagram illustrating a toner neutralization module according to an exemplary embodiment. The toner neutralization module 70B may be arranged on the travel path P of the printing medium between the developing module 30 and the fixing module 50. The toner neutralization module 70B may include an ion spraying member 74. The ion spraying member 74 may spray onto the printing medium M ions having opposite polarity to the electrified charges on the toner image. For example, if electrons are electrified on the toner image, positive ions may be sprayed onto the printing medium M.

In at least one exemplary embodiment, the toner image may be electrically neutralized by the ion spraying member 74 before being fixed. As explained above, if the toner image is neutralized, the amount of the activated SVOC 204 is reduced, and the amount of the FP and UFP 210 (charged and uncharged) is also reduced.

The electromagnetic filter module 80A will be explained below.

Figure 8:
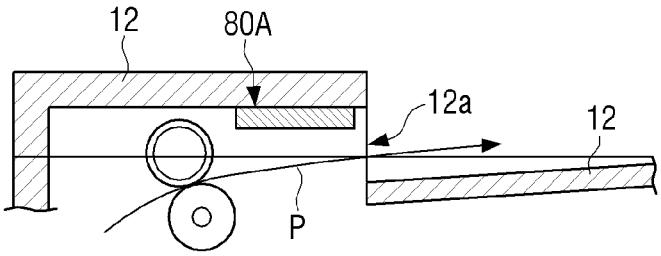
FIG. 8 is a cross-section view of an electromagnetic filter module installed proximate to a paper ejection outlet according to an exemplary embodiment.
Figure 9A:
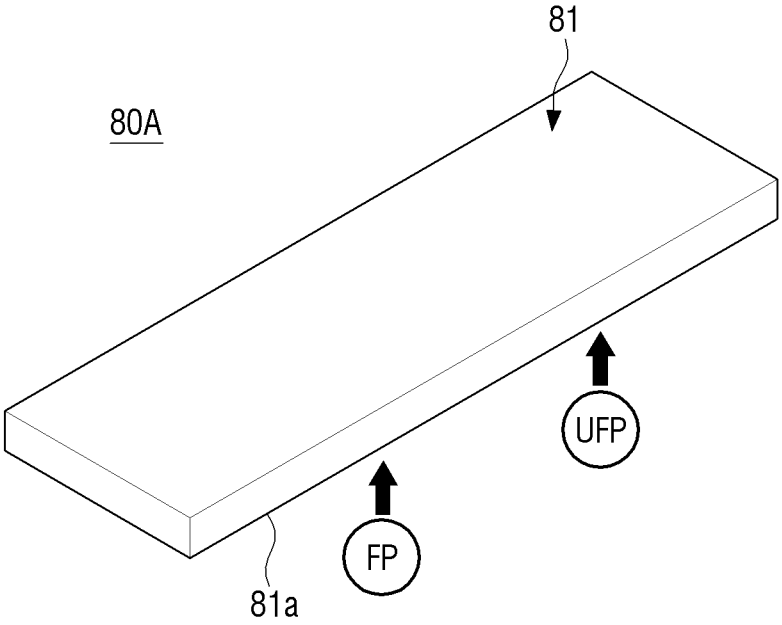
FIG. 9A is a perspective view of the electromagnetic filter unit of FIG. 8 according to an exemplary embodiment.
Figure 9B:
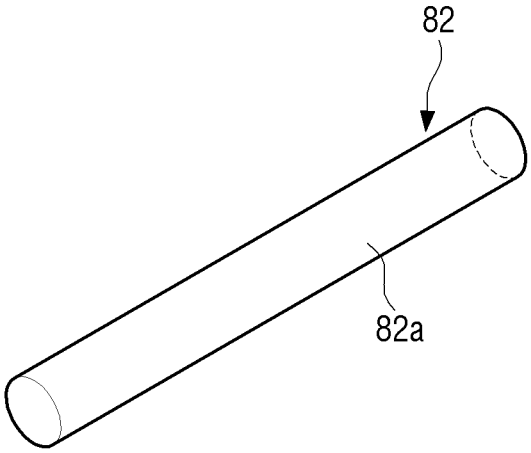
FIG. 9B is a perspective view of a electromagnetic filter module as an alternative to the electromagnetic filter module of FIG. 9A, according to an exemplary embodiment.

FIG. 8 is a cross-sectional view of an electromagnetic filter module 80A. In at least one exemplary embodiment, the electromagnetic filter module 80A may be installed proximate to a paper ejection outlet 12*a*. FIG. 9A is a perspective view of the electromagnetic filter module 80A of FIG. 8 according to an exemplary embodiment, and FIG. 9B is a perspective view of an electromagnetic filter module 82 as an alternative to the electromagnetic filter module 80A of FIG. 9A, according to an exemplary embodiment.

Referring to FIGS. 8 and 9A, the electromagnetic filter module 80A may be installed on the upper casing 12 of the image forming apparatus 1, and arranged adjacent to the paper ejection outlet 12*a*. The electromagnetic filter module 80A may include a magnetic field forming member 81. The magnetic field forming member 81 may be a rectangular plate of permanent magnet. It can be appreciated, however, that the magnetic field forming member 81 may be formed of various different shapes. Alternatively, the magnetic field forming member may include an electrically conductive winding and a current source to drive current through the winding. Accordingly, an electric field may be induced to attract magnetic material, as discussed in greater detail below.

If the FP and UFP produced in the image forming apparatus 1 include magnetic materials such as Fe, for example, the magnetic materials are attracted by the magnetic field formed by the magnetic field forming member 81 and are adhered to a lower surface 81*a* of the magnetic field forming member 81. Therefore, the amount of FP and UFP discharged from the paper ejection outlet 12*a* may be reduced.

The magnetic field forming member 81 is not limited to take a rectangular plate form, and may be realized as other forms. In one exemplary embodiment, referring to FIG. 9B, a cylindrical-shaped magnetic field forming member 82 may be provided and, in this case, the FP and UFP are adhered to an outer circumference 82*a* of the magnetic field forming member 82.

Figure 10:
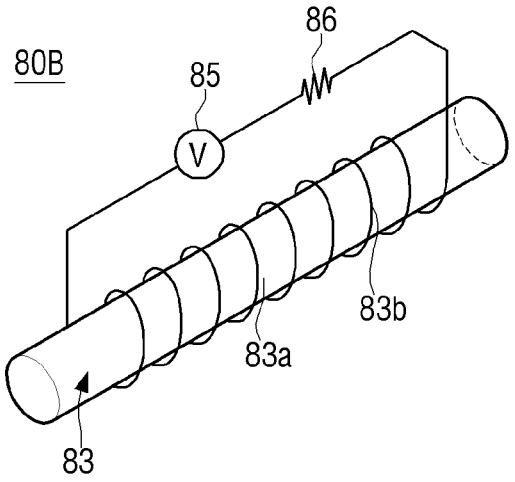
FIG. 10 is a schematic perspective view of the electromagnetic filter module according to a second exemplary embodiment.
Figure 11:
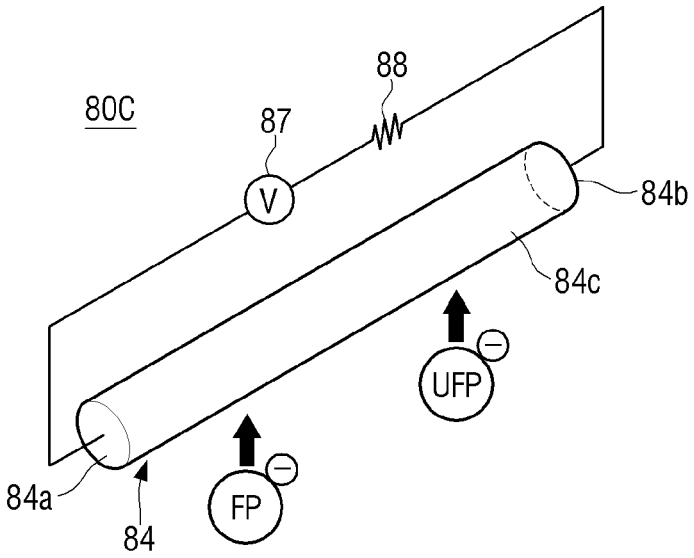
FIG. 11 is a schematic perspective view of the electromagnetic filter module according to a third exemplary embodiment.

FIG. 10 is a schematic perspective view of the electromagnetic filter module according to a second exemplary embodiment, and FIG. 11 is a schematic perspective view of the electromagnetic filter module according to a third exemplary embodiment.

Referring to FIG. 10, the electromagnetic filter module 80B as an alternative to the electromagnetic filter module 80A may include an electromagnet which includes a core member 83 and coils 83*b*. The coils 83*b* are wound around the rod-shaped core member 83 and the current of a power source 85 flows on the coils 83*b* so that the magnetic field is produced around the core member 83. The reference numeral 86 refers to resistance of the wire forming the coils.

Since the magnetic field is formed around the core member 83 of the electromagnetic filter module 80B, the FP and UFP are adhered to the outer circumference 83*a* of the core member 83, and as a result, the amount of the discharged FP and UFP is reduced. Intermittently resetting the voltage 85 applied to the coils 83*b* allows the release of the FP and UFP from the core member 83, i.e., cleans the core member 83 to maintain effectiveness.

Referring to FIG. 11, the electromagnetic filter module 80C according to a third exemplary embodiment may include an electromagnetic field forming member 84 and a power source 87. The electromagnetic field forming member 84 may be conductive material such as Cu, and may have a rod-like shape, but is not limited thereto. Both sides 84*a* and 84*b* of the electromagnetic field forming member 84 may be connected to the power source 87 so that the electrical current flows to the electromagnetic field forming member 84. The reference numeral 88 is resistance of the wire forming the coils.

When the electric current flows through the electromagnetic field forming member 84, the electromagnetic field forming member 84 forms the electromagnetic field. Referring to FIG. 11, the electrified FP and UFP are adhered to the surface 84*c* of the electromagnetic field forming member 84 by the electromagnetic field. Thus, an amount of the FP and UFP discharged from the image forming apparatus 1 may be reduced.

Referring to FIG. 11, the electromagnetic field forming member 84 may be separately provided from the electric wire. However, in another exemplary embodiment, the electric wire itself may be implemented as the electromagnetic field forming member 84.

Figure 12:
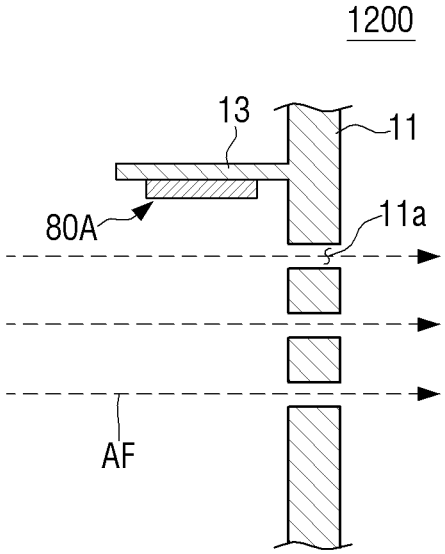
FIG. 12 is a schematic cross-section view of the electromagnetic filter module of the image forming apparatus, installed near an air ventilation outlet according to an exemplary embodiment.

FIG. 12 is a schematic cross-sectional view of the electromagnetic filter module 80A installed near an air ventilation outlet according to an exemplary embodiment.

Referring to FIG. 12, the electromagnetic filter module 80A (see FIG. 9A) may be installed adjacent to the air ventilation outlet/vent 11 a formed in the side casing/wall 11. The electromagnetic filter module 80A may be provided on an installation member/ledge 13 extended from the side casing/wall 11.

While the air in the image forming apparatus 1 is guided to the air ventilation outlet 11*a* along the air passage (AF), the FP and UFP included in the air are adhered to the electromagnetic filter module 80A. Thus, the amount of the FP and UFP discharged from the image forming apparatus 1 may be reduced.

Figure 13:
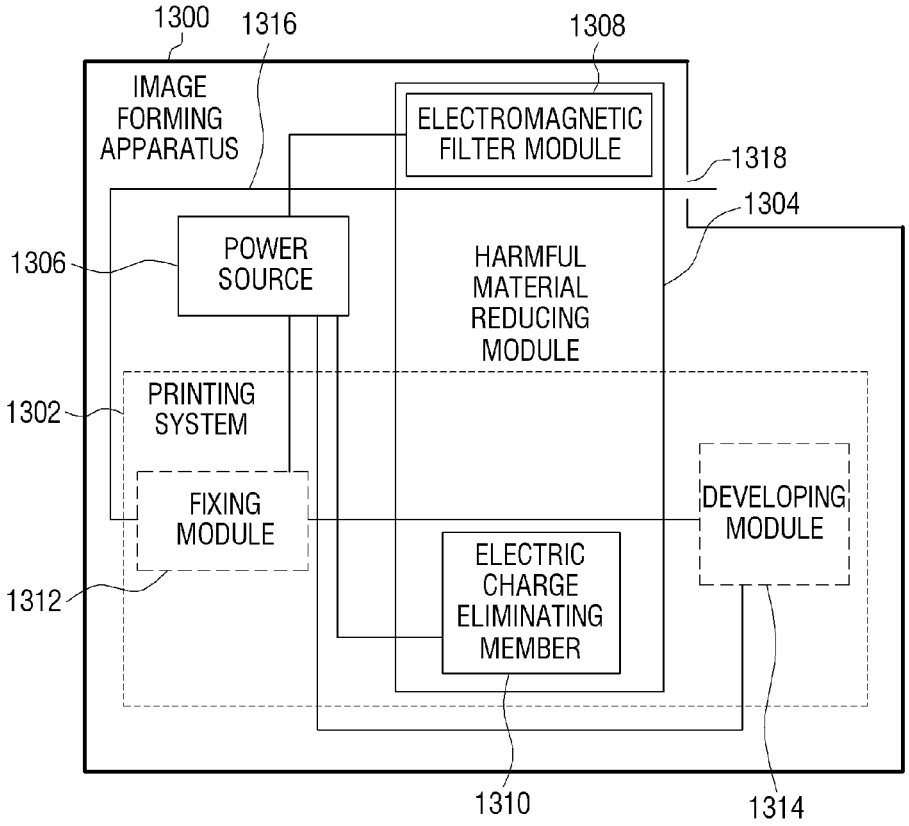
FIG. 13 is a block diagram of an image forming apparatus according to an exemplary embodiment.

As illustrated in FIG. 13, in an exemplary embodiment, an image forming apparatus 1300 has at least a developing module 1314 and a fixing module 1312 that perform an electrophotographic printing method, the image forming apparatus 1300 including a printing system 1302 and an harmful material reducing module 1304. The printing system 1302 is in electrical communication with a power source 1306 and includes at least a developing module 1314 that develops a toner image on a printing medium that travels on a travel path 1316 to a fixing module 1312 that fixes the toner image onto the printing medium. Further, the harmful material reducing module 1304 includes at least one of an electric charge eliminating member 1310, in electrical communication with the power source 1306 and arranged on the travel path 1316 of the printing medium between the developing module 1314 and the fixing module 1312, to neutralize electrified charges of a toner image on the printing medium and an electromagnetic filter module 1308, in electrical communication with the power source 1306 and arranged proximate to a printing medium ejection outlet 1318, to attract charged fine particles and ultrafine particles, minimizing output of the fine particles and ultrafine particles.

The electric charge eliminating member 1310 may be one of an electrically conductive material that includes one of a rectangular plate form, a cylindrical shape, and a plate-shaped body with pointed protrusions, and/or may be an ion-spraying member.

The electromagnetic filter module 1308 may include one of a rectangular plate of a permanent magnet, a cylindrical-shaped magnetic field forming member, an electromagnet that includes a core member and coils, and an electromagnetic field forming member in electrical communication with the power source.

In an exemplary embodiment, as illustrated in FIG. 13, an image forming apparatus 1300 performs an electrophotographic printing method and minimizes output of charged fine particles and ultrafine particles. The image forming apparatus 1300 includes a printing system 1302 which is in electrical communication with a power source 1306 and an harmful material reducing module 1304. The harmful material reducing module 1304 includes at least one of an electric charge eliminating member 1310 and an electromagnetic filter module 1308. The electric charge eliminating member 1310 is in electrical communication with the power source 1306 and is arranged on a travel path 1316 of a printing medium in the printing system 1302 to neutralize electrified charges of a toner image on the printing medium. In addition, the electromagnetic filter module 1308 is in electrical communication with the power source 1306 and is arranged proximate to a printing medium ejection outlet 1318 to attract charged fine particles and ultrafine particles, minimizing output of the fine particles and ultrafine particles.

The printing system 1302 may include at least a developing module 1314 that develops the toner image on the printing medium that travels on the travel path 1316 and a fixing module 1312 that fixes the toner image onto the printing medium.

As illustrated in FIG. 12, in an exemplary embodiment, an image forming apparatus includes a filter unit 1200 formed with a wall 11 of the image forming apparatus to filter undesired particles traveling along an outlet path. The filter unit 1200 may include at least one air ventilation outlet/vent 11*a* formed in the wall 11 and aligned with the outlet path to receive the undesirable particles therethrough and an electromagnetic filter module 80A disposed adjacent the at least one vent 11*a* to generate a magnetic field that attracts the undesirable particles traveling toward the vent 11A to the electromagnetic filter module 80A.

The electromagnetic filter module 80A may include a surface facing the outlet path such that the undesirable particles adhere to the surface due to an electromagnetic attractive force of the electromagnetic filter module 80A. Further, a ledge 13 may extend parallel with the outlet path and may have a surface facing the outlet path. The electromagnetic filter module 80A may be coupled to the ledge 13 and may face the outlet path.

In addition, the at least one vent may include a plurality of vents, each vent aligned with a respective outlet path to receive undesired particles passing therethrough.

The electromagnetic filter module s 80A, 80B, and 80C explained above may include any one of the magnetic field forming member 81, 82 and the electromagnetic field forming member 84. In another exemplary embodiment, to enhance the FP and UFP filtering efficiency, the electromagnetic filter module 80A, 80B, 80C may include both the magnetic field forming member 81, 82 and electromagnetic field forming member 84. For example, the electromagnetic filter module 80A, 80B, 80C may include the magnetic field forming member 81 of FIG. 9A and the electromagnetic field forming member 84 of FIG. 11.

Meanwhile, although the image forming apparatus 1 explained above may include both the toner neutralization, 70A and/or 70B and the electromagnetic filter module 80A, 80B, and/or 80C, the image forming apparatus may also include merely one of the toner neutralization module 70A or 70B and the electromagnetic filter module, 80A, 80B, or 80C.

According to the exemplary embodiments explained above, since the toner image is electrically neutralized by the toner neutralization module 70A and/or 70B, and the electromagnetic filter module 80A, 80B, and/or 80C secondly filters the FP and UFP electromagnetically, the image forming apparatus 1 may significantly reduce the discharged amount of the FP and UFP.

Further, according to the exemplary embodiments, since the toner neutralization module s 70A and 70B and the electromagnetic filter modules s 80A, 80B, and 80C are applicable to the conventional toners, it is not required to develop the toner fixable at low-temperature and re-set the control conditions of the image forming apparatus. As a result, the amount of discharged FP and UFP may be reduced at low cost.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus adopting an electrophotographic printing method, the image forming apparatus comprising:

a developing module which develops a toner image on a printing medium;

a fixing module which fixes the toner image onto the printing medium; and a toner neutralization module arranged on a travel path of the printing medium between the developing module and the fixing module to electrically neutralize the toner image on the printing medium, wherein the toner neutralization module comprises an electric charge elimination member which is arranged in contact with the printing medium, is connected to a ground, and which has conductivity, and wherein the electric charge elimination member has a plate-like shape, with one surface being in contact with the printing medium.

2. The image forming apparatus of claim 1, wherein the toner neutralization module further comprises a power source to apply voltage to the electric charge elimination member.

3. The image forming apparatus of claim 2, wherein the power source comprises a direct current (DC) power source, and is connected to the electric charge elimination member.

4. The image forming apparatus of claim 1, wherein the electric charge elimination member comprises at least one pointed protrusion formed on one surface to be in contact with the printing medium.

5. The image forming apparatus of claim 1, wherein the toner neutralization module comprises an ion spray member which introduces ions to electrically neutralize the toner image.

6. The image forming apparatus of claim 1, further comprising an electromagnetic filter module which filters undesirable particles generated by the fixing module using electromagnetic force.

7. The image forming apparatus of claim 6, wherein the undesirable particles comprise fine particles (FP) and ultrafine particles (UFP).

8. The image forming apparatus of claim 6, comprising a paper ejection outlet through which the printing medium is discharged from the image forming apparatus, and the electromagnetic filter module is arranged on a travel path of the printing medium between the fixing module and the paper ejection outlet.

9. The image forming apparatus of claim 8, wherein the electromagnetic filter module is installed adjacent to the paper ejection outlet.

10. The image forming apparatus of claim 6, comprising at least one air outlet to discharge air in the image forming apparatus to outside and the electromagnetic filter is installed adjacent to the air outlet.

11. The image forming apparatus of claim 6, wherein the electromagnetic filter module comprises a magnetic field forming member to form magnetic field therearound.

12. The image forming apparatus of claim 11, wherein the magnetic field forming member comprises at least one of a permanent magnet and electromagnet.

13. The image forming apparatus of claim 6, wherein the electromagnetic filter module comprises an electric field forming member to form electric field therearound.

14. The image forming apparatus of claim 13, wherein the electric field forming member comprises a conductor through which electric current flows.

15. The image forming apparatus of claim 6, wherein the electromagnetic filter module comprises:

a magnetic field forming member to form magnetic field therearound; and an electric field forming member to form electric field therearound.

16. An image forming apparatus adopting an electrophotographic printing method, the image forming apparatus comprising:

a developing module which develops a toner image on a printing medium;

a fixing module which fixes the toner image onto the printing medium;

a toner neutralization module arranged on a travel path of the printing medium between the developing module and the fixing module to electrically neutralize the toner image on the printing medium; and an electromagnetic filter module to generate an electromagnetic force that filters undesirable particles discharged from the image forming apparatus, wherein the toner neutralization module comprises an electric charge elimination member which is arranged in contact with the printing medium, is connected to a ground, and which has conductivity, and wherein the electric charge elimination member has a plate-like shape, with one surface being in contact with the printing medium.

17. An image forming apparatus having at least a developing module and a fixing module to perform an electrophotographic printing method, the image forming apparatus comprising:

a printing system in electrical communication with a power source, comprising at least the developing module that develops a toner image on a printing medium that travels on a travel path to the fixing module that fixes the toner image onto the printing medium; and an harmful material reducing module comprising at least one of:

an electric charge eliminating member, in electrical communication with the power source and arranged on the travel path of the printing medium between the developing module and the fixing module, to neutralize electrified charges of a toner image on the printing medium; and an electromagnetic filter module, in electrical communication with the power source and arranged proximate to a printing medium ejection outlet, to attract charged fine particles and ultrafine particles, minimizing output of the fine particles and ultrafine particles, wherein the toner neutralization module comprises an electric charge elimination member which is arranged in contact with the printing medium, is connected to a ground, and which has conductivity, and wherein the electric charge elimination member has a plate-like shape, with one surface being in contact with the printing medium.

18. The image forming apparatus of claim 17, wherein the electric charge eliminating member is one of:

an electrically conductive material that comprises one of: a rectangular plate form, a cylindrical shape, and a plate-shaped body with pointed protrusions; and an ion-spraying member.

19. The image forming apparatus of claim 17, wherein the electromagnetic filter module comprises: one of a rectangular plate of a permanent magnet, a cylindrical-shaped magnetic field forming member, an electromagnet that includes a core member and coils, and an electromagnetic field forming member in electrical communication with the power source.

20. An image forming apparatus to perform an electrophotographic printing method and minimize output of charged fine particles and ultrafine particles, the image forming apparatus comprising:

a printing system in electrical communication with a power source; and an harmful material reducing module comprising at least one of:

an electric charge eliminating member, in electrical communication with the power source and arranged on a travel path of a printing medium in the printing system, to neutralize electrified charges of a toner image on the printing medium; and an electromagnetic filter module, in electrical communication with the power source and arranged proximate to a printing medium ejection outlet, to attract charged fine particles and ultrafine particles, minimizing output of the fine particles and ultrafine particles, wherein the toner neutralization module comprises an electric charge elimination member which is arranged in contact with the printing medium, is connected to a ground, and which has conductivity, and wherein the electric charge elimination member has a plate-like shape, with one surface being in contact with the printing medium.

21. The image forming apparatus of claim 20, wherein the printing system comprises at least:

a developing module that develops the toner image on the printing medium that travels on the travel path; and a fixing module that fixes the toner image onto the printing medium.

* * * * *